US008855516B2

(12) United States Patent
Koyama et al.

(10) Patent No.: US 8,855,516 B2
(45) Date of Patent: Oct. 7, 2014

(54) IMAGE FORMING APPARATUS INCLUDING AIR BLOWING MEMBER CONFIGURED TO BLOW AIR TOWARD A PRESSING MEMBER FORMING A NIP PORTION WITH A FIXING MEMBER

(71) Applicant: Canon Kabushiki Kaisha, Tokyo (JP)

(72) Inventors: Tomooku Koyama, Suntou-gun (JP); Ken Murooka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 13/622,597

(22) Filed: Sep. 19, 2012

(65) Prior Publication Data

US 2013/0078016 A1 Mar. 28, 2013

(30) Foreign Application Priority Data

Sep. 22, 2011 (JP) ..... 2011-207012

(51) Int. Cl.
*G03G 15/20* (2006.01)

(52) U.S. Cl.
CPC ..... *G03G 15/2003* (2013.01); *G03G 15/2042* (2013.01); *G03G 15/2017* (2013.01)
USPC ..... 399/69; 399/45; 399/92

(58) Field of Classification Search
USPC ..... 399/43, 45, 69, 92, 334
See application file for complete search history.

(56) References Cited

U.S. PATENT DOCUMENTS 7,949,280 B2 * 5/2011 Arimoto et al. ..... 399/92

FOREIGN PATENT DOCUMENTS

| | | | |
|---|---|---|---|
| JP | 4-180076 | A | 6/1992 |
| JP | 5-107983 | A | 4/1993 |
| JP | 2007-310129 | A | 11/2007 |
| JP | 2008-32903 | A | 2/2008 |
| JP | 2008-116858 | A | 5/2008 |

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes; an image forming station for forming a toner image on a sheet; a fixing device including a fixing member and a pressing member; an air feeding member for air feeding cooling air toward the pressing member; and a shutter, provided between the air feeding member and the pressing member, for controlling an air feeding region, wherein the image forming apparatus operable selectively in a first mode for feeding the air an entire area with respect to the longitudinal direction of the pressing member, and in a second mode for feeding the air only a non-sheet-passing area when a small size sheet is fed.

12 Claims, 12 Drawing Sheets

(a)

(b)

(a)

(b)

(a)

(b)

IMAGE FORMING APPARATUS INCLUDING AIR BLOWING MEMBER CONFIGURED TO BLOW AIR TOWARD A PRESSING MEMBER FORMING A NIP PORTION WITH A FIXING MEMBER

FIELD OF THE INVENTION AND RELATED ART

The present invention relates to an image forming apparatus, such as a printer, a copying machine, a facsimile machine, etc., which is equipped with a fixing device for fixing a toner image formed on a sheet of recording medium, to the sheet of recording medium. It also related to an image forming apparatus having two or more functions of the preceding machines.

Generally speaking, an image forming apparatus such as the above described ones forms an unfixed toner image on a sheet of recording medium, with the use of one or more of its image formation stations, and then, fixes the unfixed toner image to the sheet of recording medium, with the use of its fixing device.

There have been proposed various fixing methods for a fixing device. However, most widely known among these methods is the one that fixes an unfixed toner image to a sheet of recording medium by applying heat and pressure to the toner image and sheet. An image fixing device which uses this fixing method has: a rotational heating member (heating roller, heating film, or the like), which is heated by a heating means; and a rotational pressing member (pressure application roller, pressure application film, or the like) which forms a fixation nip by being pressed upon the rotational heating member. In operation, the fixing device thermally fixes an unfixed toner image borne on a sheet of recording medium by introducing the sheet of recording medium, on which the unfixed toner image is present, into its fixation nip, and conveys the sheet of recording medium and unfixed toner image through the fixation nip while keeping the sheet of recording medium and unfixed toner image pinched by its rotational heating member and rotational pressing member, so that the unfixed toner image is fixed to the sheet of recording medium by the heat and pressure applied to the sheet of recording medium and unfixed toner image by the rotational heating member and rotational pressing member, in the fixation nip.

When an unfixed toner image on a sheet of recording medium is fixed to the sheet of recording medium by a fixing device such as the above described ones, the portion of the rotational heating member, which is within the path of a sheet of recording medium in terms of the direction perpendicular to the recording medium conveyance direction, becomes roughly uniform in surface temperature. However, if a substantial number of sheets of recording medium which are narrower than the widest sheet of recording medium conveyable through the fixing device are continuously conveyed through the fixing device, the portion of the rotational heating member, which is outside the recording medium path, excessively increases in temperature. This phenomenon occurs for the following reason: As a substantial number of narrow sheets of recording medium are continuously conveyed through the fixing device, heat is not robbed from the portion of the rotational heating member, which is outside the recording medium path. Therefore, heat accumulates in this portion of the rotational heating member.

As the surface temperature of the rotational heating member increases, the surface temperature of the rotational pressing member also increases, because the rotational pressing member is kept pressed on the rotational heating member.

This phenomenon that both the portion of the rotational heating member, which is outside the recording medium path, and the portion of the rotational pressing member, increase in surface temperature is referred to as lengthwise end temperature increase, or out-of-sheet-path (non-sheet-passing-area) temperature increase, of a fixing device. If this out-of-sheet-path temperature increases becomes excessive, such a problem as "hot offset" occurs, and/or the structural components of the fixing device (and also, image forming apparatus) are thermally damaged. Therefore, various methods have been proposed to prevent this excessive temperature increase of the out-of-sheet-path portions of the rotational heating member and rotational pressing member of a fixing device. Two of these methods are disclosed in Japanese Laid-open Patent Applications H05-107983 and 2008-32903, one for one. According to these patent documents, a fixing device is provided with an air blower (fan) so that the excessive temperature increase of the portion of the rotational heating member and the excessive temperature increase of the portion of the rotational pressing member can be prevented by sending airflow to these portions.

More specifically, the fixing device disclosed in Japanese Laid-open Patent Application H05-107983 is provided with multiple fans, which are arranged along the rotational pressure applying member (which hereafter may be referred to simply as "pressure roller"). It uses the information about the size and basis weight of a sheet of recording medium to control the timing with which the fans are turned on or off, and the amount by which airflow is to be generated by the fans. As for the fixing device disclosed in Japanese Laid-open Patent Application 208-32903, it is structured so that when it sends cooling air across the out-of-sheet-path portion of the rotational heating member with the use of its cooling fan(s), its air outlet can be adjusted in width. Therefore, it can prevent the excessive temperature increase of the out-of-sheet-path portion of the rotational heating member, regardless of the recording medium sheet width.

In recent years, people have become increasingly concerned about environment. Thus, demands have been increasing for a fixing device which is substantially smaller in energy consumption than any of the conventional fixing devices. Therefore, various fixing devices which are capable of quickly warming up even when their temperature is as low as the ambient temperature have been put to practical use. Most of them use a heating means, such as a ceramic heater, which is low in thermal capacity, and a film which is low in thermal capacity. These fixing devices do not need to be preheated before the starting of an image forming operation. Thus, they can save the electric power which would have been consumed for preheating. On the other hand, in the case where a substantial number of sheets of recording medium begin to be continuously conveyed through a fixing device when the fixing device is cold, it occurs sometimes that the water vapor which is generated while the first fifteen sheets of recording medium is conveyed through the fixing device comes into contact with the pressure roller, the temperature of which is yet to reach above the condensation temperature level, and condenses on the pressure roller.

Occurrence of condensation to the pressure roller reduces the friction between the fixation film and pressure roller, leading sometime to slipping between the fixation film and pressure roller (which here after may be referred to simply as "condensation slip"). As the slipping occurs between the fixation film and pressure roller, it is virtually impossible for the fixing device to convey a sheet of recording medium through its fixation station (nip). Thus, as a sheet of recording medium is conveyed from the image formation station to the fixing device, it slackens between the image formation station and fixing station, making it likely for an image forming apparatus to end up forming a defective image and/or suffering from paper jam. Therefore, various technologies for solving this problem have been proposed. One of these technologies is disclosed in Japanese Laid-open Patent Application 2008-116858. According to this patent application, a fan is positioned below a fixing device to prevent the "condensation slip". In operation, the fan is activated in response to the driving of the pressure roller, in order to prevent the condensation in the fixing device.

Referring to FIGS. 14-16, according to one of the known conventional solutions to the above described problem, fans are positioned next to the fixation film and pressure roller. More specifically, fixing device is provided with: a combination of a fan and a duct, which is for cooling the fixation film; means which is for preventing the out-of-sheet-path portion of the heating film and/or the out-of-sheet-path portion of the pressure roller excessively increasing in temperature, and is equipped with a shutter for adjusting the air outlet in dimension in terms of the direction perpendicular to the recording medium conveyance direction; and a combination of a fan and a duct, which is for sending air to the pressure roller. Referring to FIGS. 14-16, reference sign 81*a* and 81*b* stand for the fans for generating the airflow for cooling the out-of-sheet-path portion of the fixation film 31, and reference signs 83*a* and 83*b* stand for the duct for guiding the airflow generated by the fans 81, to the fixation film 31.

Further, a reference sign 82 stands a shutter for directing the airflow generated by the fan, toward the out-of-sheet-path portion of the fixation film 31. The shutter 82 is positioned in the duct 83, between the fan 81 and fixation film 31. This shutter 82 is for adjusting in size the opening (air outlet) of the duct 83 to cool the out-of-sheet-path portion of the fixation film 31, according to the size of the sheet of recording medium. The shutter 82 is an integral combination of a shutter section 82*a* (FIG. 15), a rack section 82*b* (FIG. 15), and a flag section 82*c* (FIG. 16).

The rack section 82*b* of the shutter 82 is in connection to a motor 87 (pulse motor for cooling out-of-sheet-path portion of film 31) through a reduction gear 90. The fixing device 30 is structured so that as the motor 87 is rotated forward or in reverse, the rack section 82*b* is moved to adjust in size the opening (air outlet) of the duct 83, and also, so that the shutter 82 can be placed in its home position, by detecting the position of the flag 82*c* by a detecting means 89.

Further, designated by a reference sign 85 is a fan for sending airflow to the pressure roller 34 to prevent the condensation on the pressure roller. Designated by a reference sign 86 is a duct for guiding the airflow from the fan 85 to the duct 84 for preventing the condensation on the pressure roller 34. The duct 84 is provided with a large number of holes, which are aligned in the lengthwise direction of the pressure roller 34. Thus, the airflow generated by the fan 85 is made to flow through the duct 84, is forced out of the duct 84 through these holes to be blown upon the peripheral surface of the pressure roller 34.

In recent years, image forming apparatuses which are low in thermal capacity and low in energy consumption have been put to practical use as described above. On the other hand, demands have been increasing for image forming apparatuses which are higher in productivity. Thus, there has been a trend to increase an image forming apparatus in the number of the fans for generating the airflow for preventing the above described unwanted increase in the temperature of the out-of-sheet-path portion of the fixation film, and also, in the number of the fans for generating the airflow for the prevention of the condensation slip. The increase in the number of fans invites not only the increase in the overall cost for the fans, and the overall cost for the image heating device, because it requires for the power sources, electrical circuits, control circuits, air duct, covers, etc., to be increased according to the number of the fans.

Also in recent years, it has been desired to reduce an image forming apparatus in energy consumption, size, and cost, while increasing in productivity (reduce length of time required to print each print). There are various means to satisfying the desire. One of the means which greatly contributes to the satisfaction of the desire is the reduction in the number of fans.

SUMMARY OF THE INVENTION

Thus, the primary object of the present invention is to provide such a structural arrangement for an image forming apparatus, that makes it possible for a single airflow generating means (fan) to be used not only for preventing the out-of-sheet-path portion of the image fixing section of the apparatus from excessively increasing in temperature, but also, for the prevention of the condensation slip, in order to provide an image forming apparatus which is substantially smaller in size, and also, substantially lower in cost, than any of image forming apparatuses in accordance with conventional art.

According to an aspect of the present invention, there is provided an image forming apparatus for forming a toner image on a recording material, said apparatus comprising an image forming station for forming a toner image on the recording material; a fixing portion including a fixing member and a pressing member for contacting said fixing member to form a nip therebetween, wherein said fixing portion heats the toner image while feeding the recording material by said nip to fix the toner image on the recording material; an air feeding member for air feeding cooling air in a direction perpendicular to a longitudinal direction of said pressing member toward said pressing member; and a shutter, provided between said air feeding member and said pressing member, for controlling an air feeding region of said air feeding member to said pressing member, wherein said image forming apparatus is capable of executing an operation in a first mode for feeding the air by said air feeding member with the air feeding region set to an entire area with respect to the longitudinal direction of said pressing member, and an operation in a second mode for feeding the air by said air feeding member with the air feeding region set to only a non-sheet-passing area of a small size recording material. According to the present invention, it is possible to provide an image heating device which is substantially smaller in size and lower in cost than any of the conventional image heat devices, by sharing a single airflow generating means (fan) for preventing the out-of-sheet-path portion of the heating member and the out-of-sheet-path portion of the pressure applying means from excessively increasing in temperature, and also, for preventing the condensation slip.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS (Image Forming Apparatus)

Figure 2:
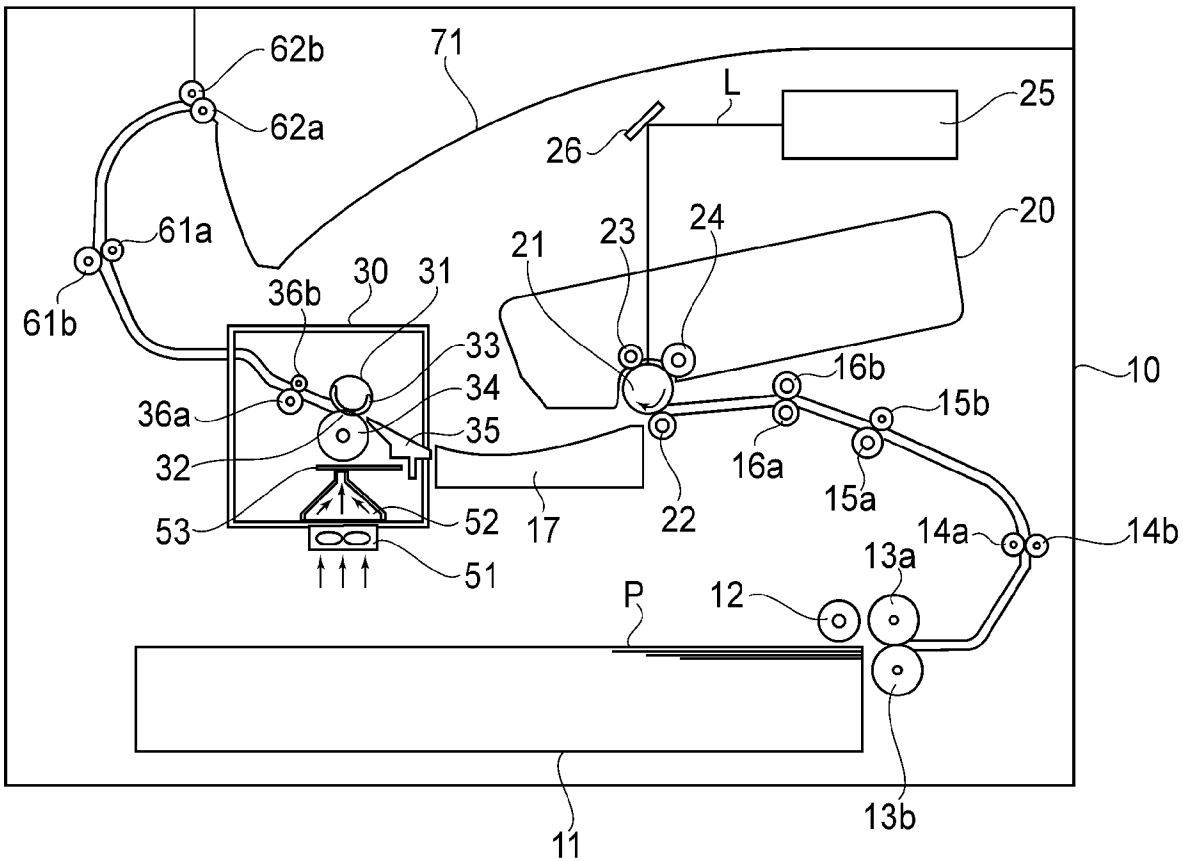
FIG. 2 is a schematic sectional view of an image forming apparatus which employs the image heating device in the first embodiment, at a plane parallel to the recording medium conveyance direction of the apparatus.

FIG. 2 is a schematic sectional view of the image forming apparatus equipped with the image heating device in the first embodiment of the present invention, at a vertical plane perpendicular to the recording medium conveyance direction of the apparatus, and shows the general structure of the apparatus. The image forming apparatus 10 is provided with a photosensitive drum 21 as an image bearing member, which is rotationally driven in the direction (clockwise direction) indicated by an arrow mark, at a preset process speed, by an unshown motor as the mechanical power source for driving the photosensitive drum 21. Here, the process speed of the image forming apparatus 10 is 250 mm/sec.

Further, the image forming apparatus 10 has: a charge roller 23 as a charging device; an exposing device 25; a developing device; a transfer roller 22 as a transferring device; etc., which are in the adjacencies of the peripheral surface of the photosensitive drum 21, being positioned in the listed order, in terms of the rotational direction of the photosensitive drum 21. These devices and photosensitive drum 21 make up the image formation station 20 which forms an image on a sheet of recording medium.

The image forming apparatus 10 has also a recording medium cassette 11 in which sheets of recording medium (paper, printing paper, OHT sheet, glossy paper, glossy film, etc.) are stored, and from which the sheets of recording medium are fed one by one into the main assembly of the image forming apparatus 10. The cassette 11 is in the bottom portion of the image forming apparatus 10. Along the recording medium conveyance passage of the image forming apparatus 10, a recording medium feeding roller 12, a first pair of recording medium conveyance rollers 13, a second pair of recording medium conveyance roller 14, a third pair of recording medium conveyance rollers 15, a fourth pair of recording medium conveyance roller 16, a combination of the photosensitive drum 21 and a transfer roller 22, the fixing device 30, a fifth pair of recording medium conveyance roller 61, a pair of discharge rollers 62, and a delivery tray 71, are disposed in the order in which they are listed above.

Next, the operation of the image forming apparatus 10, which is structured as described above, is described. As the photosensitive drum 21 is rotated in the direction (clockwise direction) indicated by the arrow mark, by the unshown motor, the peripheral surface of the photosensitive drum 21 is uniformly charged to a preset potential polarity and level by the charge roller 23. The exposing device 25 is a laser scanner, which scans (exposes) the uniformly charged portion of the peripheral surface of the photosensitive drum 21, by projecting a beam L of laser light, while modulating the beam L of laser light with electrical signals which reflect the information of the image to be formed, and are inputted from a host apparatus, such as an unshown computer, an unshown image reading device, or the like, and also, while deflecting the beam L of laser light with its deflection mirror 26. Thus, electric charge is removed from exposed points of the peripheral surface of the photosensitive drum 21. Consequently, an electrostatic latent image is formed on the peripheral surface of the photosensitive drum 21.

The electrostatic latent image is developed by a developing device 24. The developing device 24 has a development roller. As development bias is applied to the development roller, the toner on the peripheral surface of the development roller adheres to the electrostatic image on the photosensitive drum 21, developing the latent image into a visible image (image formed of toner). Then, the toner image on the peripheral surface of the photosensitive drum 21 is transferred by the transfer roller 22, onto a sheet P of recording medium.

Meanwhile, the sheets P of recording medium in the cassette 11 are fed one by one into the main assembly of the image forming apparatus 10 by the recording medium feed roller 12, and conveyed by the first to fourth pairs of recording medium conveyance rollers 13-16, toward the transfer nip, which is between the photosensitive drum 21 and transfer roller 22. As each of the sheets P of recording medium is conveyed as described above, the leading edge of the sheet P is detected by the unshown edge sensor so that the conveyance of the sheet P to the fixation nip is synchronized with the arrival of the toner image on the photosensitive drum 21 at the fixation nip. To the transfer roller 22, transfer bias is applied, whereby the toner image on the photosensitive drum 21 is transferred onto a preset area of the sheet P.

After the transfer of an unfixed toner image onto the sheet P of recording medium, the sheet P is conveyed to the fixation nip of the fixing device 30 (as image heating device) while being guided by a recording medium conveyance guide 17 and an entrance guide 35. Then, the sheet P on which the unfixed toner image is present is conveyed through the fixation nip of the fixing device 30 while being heated. Thus, the unfixed toner image on the sheet P is fixed to the sheet P. After the fixation of the toner image to the sheet P, the sheet P is conveyed by a pair of discharge rollers 36 to the fifth pairs of recording medium conveyance roller 61, and then, is conveyed to the pair of discharge rollers 62. Finally, the sheet P is discharged from the main assembly of the image forming apparatus 10 into the delivery tray 71. The above described operation can be continuously repeated to continuously form images.

(Image Heating Device)

In the following description of the fixing device 30 as an image heating device, and the structural components of the device, "lengthwise direction" means the direction parallel to the direction which is perpendicular to the direction in which a sheet of recording medium is conveyed through the recording medium conveyance passage. It means also the direction parallel to the widthwise direction of the fixation film, and the direction parallel to the axial line of the pressure roller. Regarding the fixing device 30, the "front surface" means the surface of the fixing device 30, from the side of which a sheet of record medium is introduced into the fixing device 30. The "left and right sides" means the left and right sides of the fixing device 30, respectively, as seen from the front surface side. The "width" of a sheet of recording medium means the measurement of the sheet in terms of the direction perpendicular to the recording medium conveyance direction of the sheet in the fixing device.

Figure 3:
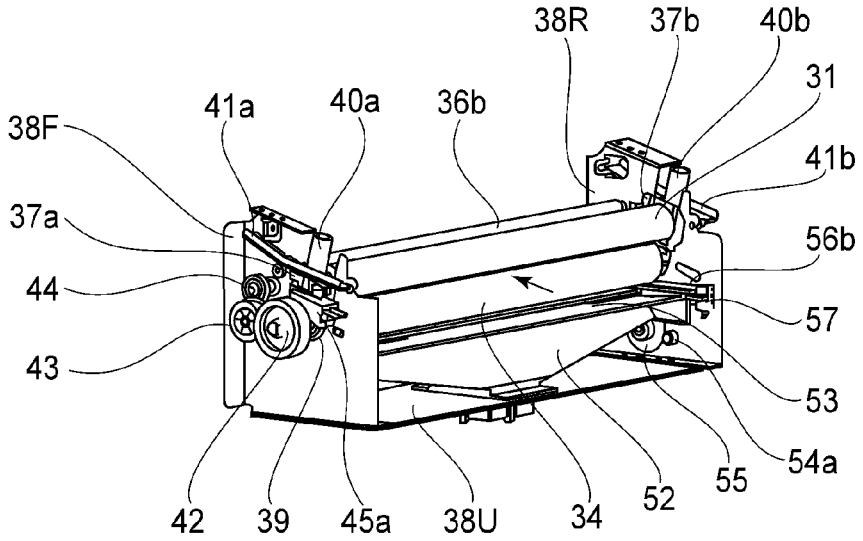
FIG. 3 is a perspective view of the fixing device, as an image heating device, in the first embodiment, as seen from the top-left side of the device.
Figure 4:
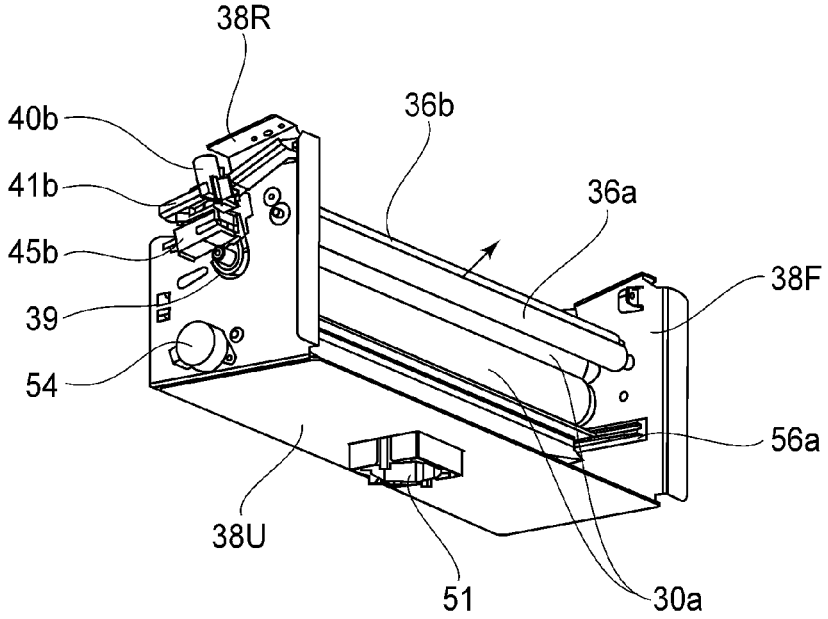
FIG. 4 is a perspective view of the fixing device, as an image heating device, in the first embodiment, as seen from the bottom-left side of the device.
Figure 5:
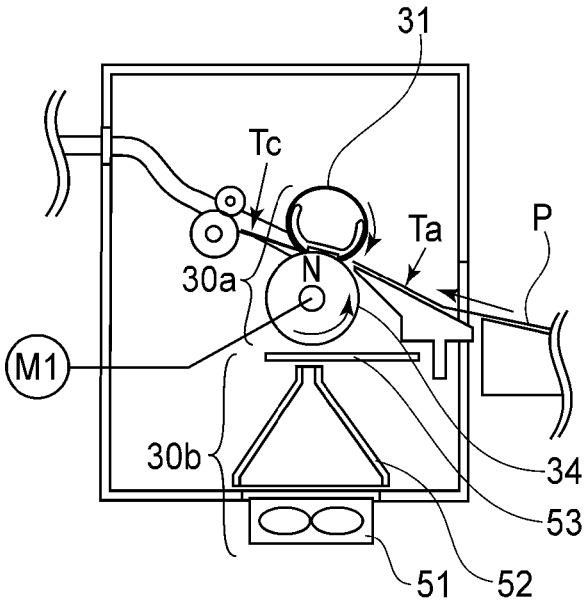
FIG. 5 is a schematic sectional view of the fixing device in the first embodiment, at a horizontal plane parallel to the recording medium conveyance direction of the device.
Figure 6:
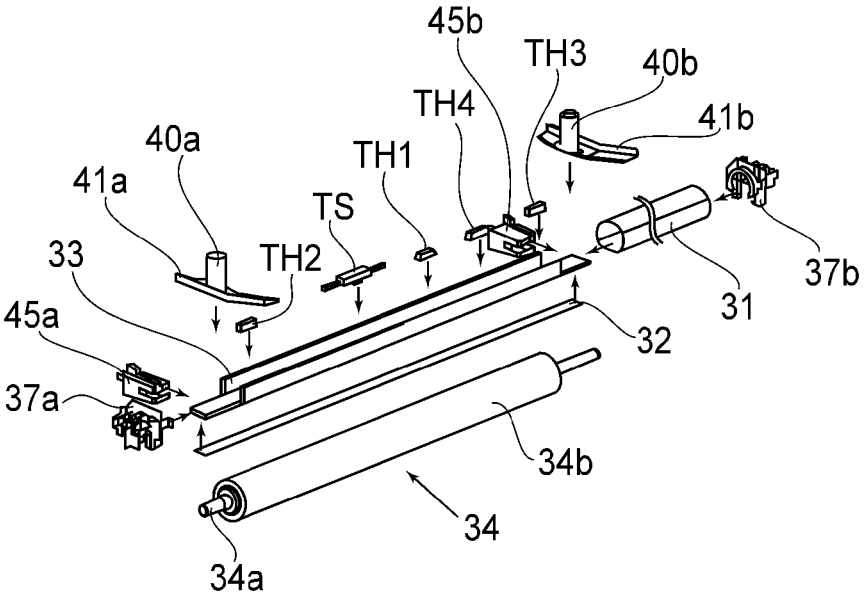
FIG. 6 is an exploded view of the essential portion of the fixing device in the first embodiment.

FIGS. 3 and 4 are perspective views of the fixing device 30 as seen from the different directions. The arrow mark in the drawings indicates the direction in which a sheet P of recording medium is conveyed. FIG. 5 is a schematic sectional view of the fixing device 30, at a vertical plane parallel to the recording medium conveyance direction. Referring to FIG. 5, the fixing device 30 is made up of a fixation unit 30*a* and a blower unit 30*b*. FIG. 6 is an exploded perspective view of the fixation unit 30*a*.

1) Fixation Unit 30*a*

Referring to FIGS. 2-6, the fixation unit 30*a*, as the main section, of the fixing device 30 is described about its structure. The fixation unit 30*a* is the main section of the fixing device 30 which heats an object to be heated, through a sheet of film (which hereafter may be referred to as film-based heating device). Referring to FIG. 3, the fixation unit 30*a* has a cylindrical film 31 as a fixing member, and a pressure roller 34 as a pressure applying member. Referring to FIG. 5, the area of contact between the film 31 and pressure roller 34 is the fixation nip N.

A reference sign 33 stands for a fixation stay, which is rigid and heat resistant. It is shaped so that its cross section at a vertical plane perpendicular to its lengthwise direction is roughly semicircular. A reference sign 32 in FIG. 2 stands for a ceramic heater (which hereafter will be referred to simply as heater). The heater 32 is in contact with the inward surface of the film 31. It is attached to the fixation stay 33. More concretely, the outward side of the fixation stay 33 is provided with a groove, which extends in the lengthwise direction of the stay 33, and the heater 32 is fitted in this groove of the stay 33. The film 31 is loosely fitted around the fixation stay 33. Reference signs 37*a* and 37*b* stand for a pair of flanges fitted around the left and right arms which extend in the lengthwise direction of the fixation stay 33 from the left and right ends, respectively, of the stay 33.

The film 31 is multilayered. It is made up of a base layer, an elastic layer, a parting layer, etc. The base layer is made of heat resistant resin or metal. The elastic layer, parting layer, etc., are layered on the outward surface of the base layer, in the listed order. The film 31 is thin, flexible, highly heat resistant, and low in thermal capacity.

The heater 32 is a heating member which is thin, long, narrow, and low in thermal capacity. It is positioned so that its lengthwise direction is parallel to the recording medium conveyance direction. The heater 32 is made up of a substrate and a heat generation layer. The substrate is made of ceramic such as aluminum nitride, alumina, or the like. The heat generation layer is formed on the substrate, of silver-palladium or the like, which generates heat as electrical current is flowed through it. The ceramic heater in this embodiment is provided with three heat generating members, which are aligned in the lengthwise direction of the heater 32, and can be independently controlled from each other in the amount by which they are provided with electrical current. Thus, the ceramic heater 32 can be adjusted in the size of its heat generating range in terms of its lengthwise direction, according to the above described "width" of a sheet of recording medium, by controlling each of three heat generating members independently from each other.

The pressure roller 34 is made up of a metallic core 34*a* and an elastic layer 34*b*. The elastic layer 34*b* is formed of silicone rubber or the like, and covers the entirety of the peripheral surface of the metallic core 34*a*, reducing the pressure roller 34 in overall hardness. For the improvement of surface property, the elastic layer 34*b* of the pressure roller 34 may be coated with fluorinated resin, such as PTFE (polytetrafluoroethylene), PFA ((tetrafluoroethylene-perfluoroalkylvinylether copolymer), or the like. The pressure roller 34 is rotatably supported by the left and right ends of the metallic core 34*a*, by the front and rear plates 38F and 38R of the fixing device 30, with the placement of a pair of bearings 39 between the left and right ends of the metallic core 34*a* and the front and rear plates 38*f* and 38R, respectively. The left and rear plates 38F and 38R are connected to each other by a bottom plate 38U of the fixing device 30.

The film 31 is positioned parallel to the pressure roller 34 in such a manner that the portion of the film 31, which is in contact with the heater 32 faces the pressure roller 34. Further, the fixing device 30 is provided with a pair of pressure plates 41 (left and right plates 41*a* and 41*b*) and a pair (left and right)

pressure application mechanisms. The left and right plates 41*a* and 41*b* are attached to the top surface of the left flange 37*a* and the top surface of the right flange 37*b*, respectively. The pressure application mechanism is made up of left and right compression springs 40*a* and 40*b* made of stainless steel. The left and right pressure plates 41*a* and 41*b* are kept under a preset amount of pressure generated by the pressure generation mechanism. Thus, the heater 32 is kept pressed against the pressure roller 34, with the presence of the film 31 between itself and the pressure roller 34, forming the fixation nip N between the film 31 and pressure roller 34.

A reference sign 42 in FIG. 3 stands for a pressure roller gear attached to the left end of the metallic core 34*a* of the pressure roller 34. To the pressure roller gear 42, the driving force from a fixation motor M1 is transmitted through unshown driving force transmitting members. As the driving force from the fixation motor M1 is transmitted to the pressure roller gear 42, the pressure roller 34 is rotated in the direction (counterclockwise) indicated by an arrow mark in FIG. 5. Thus, the portion of the film 31, which is in the fixation nip N, is subjected to the friction between the film 31 and pressure roller 34. Therefore, the film 31 is circularly moved around the fixation stay 33, in the direction (clockwise direction) indicated by another arrow mark, sliding on the heater 32 while remaining in contact with heater 32 with its inward surface.

The film 31 circularly moves at a velocity which is roughly equal to the peripheral velocity of the pressure roller 34. The left and right flanges 37 play the role of regulating the lateral movement of the film 31. More concretely, as the film 31 shifts leftward or rightward in the lengthwise direction of the fixation stay 33 while being circularly moved, the left and right flanges 37 catch the film 31 by the edge of the film, which is on the side toward which the film 31 is shifting. The inward surface of the film 31 is coated with grease (lubricant) to ensure that the film 31 smoothly slides on the heater 32 and fixation stay 33.

The sheet P of recording medium is conveyed through the fixation nip N while being guided by the entrance guide 35 shown in FIG. 2. In the case of the image forming apparatus in this embodiment, each sheet P of recording medium is conveyed through the fixing device 30 so that the widthwise center of the sheet P coincides with the center line of the recording medium passage in terms of the widthwise direction of the passage. That is, when a sheet of recording medium P is conveyed through the fixing device (image forming apparatus), its widthwise centerline coincides with the widthwise centerline of the film 31. A reference sign S in FIG. 11 stands for the center line of the fixing device 30, which is the theoretical referential line for recording medium conveyance.

Referring to FIG. 6, designated by reference signs TH1-TH4 are four thermistors as the first to fourth temperature detecting members. Each thermistor is positioned in contact with the back surface of the heater 32, and is used to detect the surface temperature of the portion of the back side of the heater 32, with which it is in contact. Designated by a reference sign TS is a thermo-switch, which is positioned in contact with the back surface of the heater 32 like the aforementioned four thermistors TH1-TH4. Incidentally, the electrical wire for supplying the heater 32 with electric power is routed through the thermo-switch TS.

As the temperature of the thermo-switch TS exceeds a preset level, the thermo-switch TS temporarily breaks the power supply line to the heater 32 to stop the heater 32 from being supplied with electric power. That is, as the temperature of the heater 32 exceeds a preset level, the thermo-switch TS temporarily breaks the power supply line to the heater 32 to prevent the problems which might occur to the fixation unit. The heater 32 quickly increases in temperature across its entire range as electric current is flowed through the heat generation layer on the substrate of the heater 32, by the heater driving circuit. The temperature of the heater 32 is detected by the main thermistor TH1, and the electrical signals which reflect the heater temperature are inputted into the control circuit by way of an unshown A/D converter.

Further, the temperature of the film 31 is also detected by the end thermistors TH2, TH3, and sub-thermistor TH4, and the electrical signals reflecting the temperature of the film 31 are inputted into the control circuit by way of the A/D converter. The control circuit determines how the fixation heater 32 is to be controlled in temperature, based on the outputs of the main thermistors TH1, end thermistor TH2, end thermistor TH3, and sub-thermistor TH4. Then, it controls the amount by which electric power is to be supplied to the fixation heater 32 from the heater driving circuit.

The control circuit drives the fixation motor M1 by controlling the fixation motor driving circuit, based on the print signals from an external host apparatus, or other control signals. As the fixation motor M1 is driven, the pressure roller 34 is rotationally driven, causing the film 31 to circularly move. Further, the control circuit makes the heater 32 to generate heat, by controlling the heater driving circuit. As the fixation film 31 stabilizes in the speed with which it circularly moves, and the temperature of the heater 32 reaches a preset level for fixation, a sheet P of recording medium on which an unfixed toner image Ta is borne is introduced into the fixation nip N while being guided by the entrance guide 35. Thus, the toner image on the sheet P comes into contact with the film 31.

Then, the sheet P of recording medium is moved, along with the fixation film 31, through the fixation nip N. While the sheet P is conveyed through the fixation nip N, heat is given to the sheet P by the film 31, and the sheet P and the toner image thereon are subjected to the pressure in the fixation nip N. Thus, the toner image Tc becomes fixed to the surface of the sheet P. After being conveyed through the fixation nip N, the sheet P is separated from the surface of the film 31, and is discharged from the main assembly of the image forming apparatus 10.

2) Blower Unit 30*b*

The blower unit 30*b* shown in FIG. 5 is provided with a fan 51 as a member for sending cooling air to the pressure roller 34. One of the reasons why airflow is directed upon the pressure roller 34 is for preventing the problem that the water vapor having evaporated from a sheet P of recording medium during the fixation of the toner image Tc to the sheet P comes into contact with the pressure roller 34, condensing and adhering to the surface of the pressure roller 34, and causes the pressure roller 34 and film 31 to slip relative to each other. Another reason why air is blown on the pressure roller 34 is for preventing the problem that as a substantial number of sheets of recording medium, which are narrower than a widest sheet of recording medium conveyable through the fixing device 30 (image forming apparatus 10), are continuously conveyed through the fixing device 30 (fixation nip N), the portions of the pressure roller 34, which are outside the recording medium path, in terms of the widthwise direction of the recording medium, excessively increases in temperature.

Figure 7:
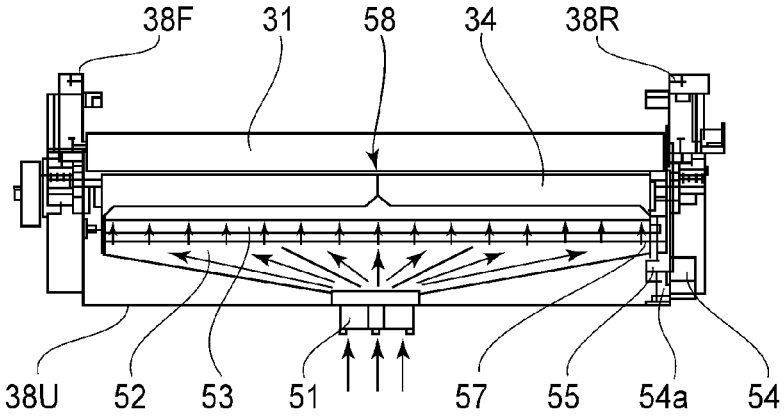
FIGS. 7(*a*) and 7(*b*) are sectional views of the essential portion of the fixing device in the first embodiment, at vertical and horizontal planes, respectively, perpendicular to the recording medium conveyance direction, when the fixing device is set for sending airflow across the lengthwise entirety of its pressure roller.
Figure 7:
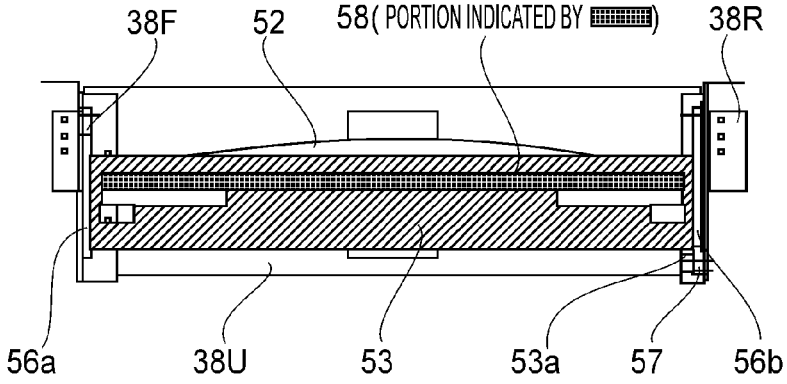
Figure 10:
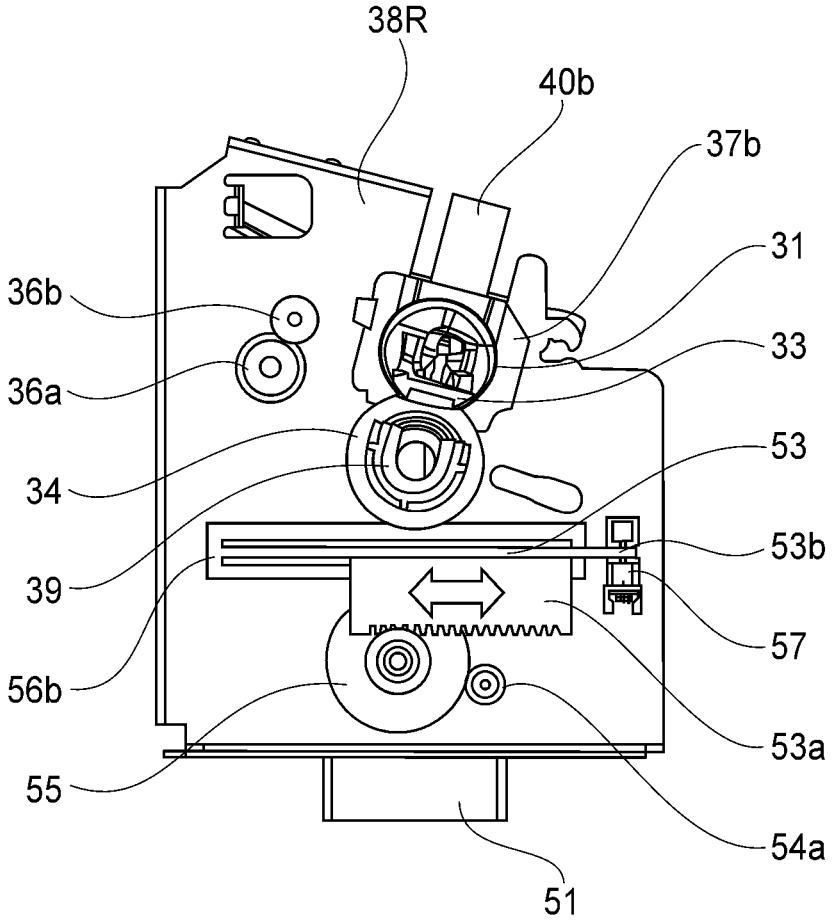
FIG. 10 is a schematic sectional view of the fixing device in the first embodiment, at a vertical plane perpendicular to the recording medium conveyance direction of the device, and shows the structure of its shutter mechanism.

FIGS. 7(*a*), 8(*a*) and 9(*a*) are sectional views of the duct portion of the blower unit 30*b*, at a horizontal plane. FIGS. 7(*b*), 8(*b*) and 9(*b*) are plan views of the duct portion of the blower unit 30*b*. FIG. 10 is a schematic sectional view of the fixing device 30, at a vertical plane parallel to the recording medium conveyance direction, and shows the structure of the shutter of the air duct. Referring to FIG. 5, a reference sign 51 stands for a blower fan, and a reference sign 52 stands for the air duct for guiding the cooling air sent from the blower fan, to the pressure roller 34. FIGS. 7(*a*), 8(*a*) and 9(*b*) are the schematic sectional views of the duct portion of the blower unit 30*b*, as seen from the left side of FIG. 5. FIGS. 7(*b*), 8(*b*) and 9(*b*) are plan views of the blower unit 30*b*, as seen from the top side of the FIG. 5. FIG. 10 is a plan view of the blower unit 30*b* as seen from the left side of the unit 30*b*.

The blower fan 51 in this embodiment is an axial-flow fan. However, it may be replaced with a centrifugal fan such as a sirocco fan.

(Cooling Area Adjustment Member)

Referring to FIG. 5, the blower unit 30*b* is provided with a shutter 53 as a member for adjusting the blower unit 30*b* in the cooling area in terms of the widthwise direction of the pressure roller 34. The shutter 53 is placed between the blower fan 51 and pressure roller 34. Further, it is placed close to the pressure roller 34 so that its openings (holes) face the pressure roller 34. The shutter 53 is movable in the direction perpendicular to the lengthwise direction of the pressure roller 34. Its opening has: a first section which extends across the entirety of the pressure roller 34 in terms of the lengthwise direction of the pressure roller 34; and a pair of second sections which extend across the corresponding portions of the pressure roller 34, one for one, which are outside the path of a narrow sheet of recording medium in terms of the widthwise direction of the sheet. The first and second sections extend in the lengthwise direction of the pressure roller 34, and are parallel to each other.

The blower unit 30*b* can be operated in the first or second mode. In the first mode, the shutter 53 is positioned so that the cooling air comes through the first section of the opening of the shutter 53 and impinges on the entirety of the pressure roller 34, in terms of the lengthwise direction of the pressure roller 34. In the second mode, the shutter 53 is positioned so that the cooling air comes through the second section of the opening of the shutter 53, and impinges on the portions of the pressure roller 34, which are outside the path of a narrow sheet of recording medium.

Each of the second sections of the opening of the shutter 53 is shaped like the cross section of a staircase so that its dimension in terms of the lengthwise direction of the pressure roller 34 can be incrementally changed according to recording medium size in order to cool only the out-of-sheet-path portions of the pressure roller 34 when a sheet of recording medium which is narrower than the widest sheet of recording medium conveyable through the fixing device 30 (image forming apparatus 10) is conveyed through the fixing device 30. Thus, the blower unit 30*b* can be adjusted in the area of the pressure roller 34 across which it sends cooling air, by moving the shutter 53 in the left-to-right or right-to-left direction (direction perpendicular to lengthwise direction of pressure roller 34) as shown in FIG. 10. Referring to FIG. 7(*b*), the shutter 53 is held and regulated by a shutter holder 56 attached to the front and rear plates 38F and 38R, and has a rack section 53*a*.

The rack section 53*a* is an integral part of the shutter 53, and is in mesh with a pinion gear 54*a*. Referring to FIG. 7(*a*), the pinion gear 54*a* can be rotated forward or backward by a shutter motor 54. As the pinion gear 54*a* is rotated forward or backward, the shutter 53 shuttles in the direction indicated by a two-headed arrow mark in FIG. 10. The opening of the shutter 53 is shaped like the cross section of a staircase, as described above, so that its dimension in terms of the direction parallel to the lengthwise direction of the pressure roller 34 can be changed in such increments that corresponds to the width of a sheet of recording medium to be conveyed for an image forming operation. Thus, the dimension of the opening 58 (airflow outlet) of the blower unit 30*b* can be changed in dimension by such increments that match the width of a sheet P of recording medium being used in an on-going image forming operation, by adjusting the distance by which the shutter 53 is moved.

Further, the shutter 53 is provided with a flag section 53*b* for indicating the position of the shutter 53, so that whether or not the shutter 53 is in its home position can be detected by a sensor 57 such as a photosensor. The shutter 53 is moved to the position which corresponds to the width of the sheet of recording medium to be used for on-going image forming operation, and stopped there, by a combination of the above described shutter position detecting mechanism and the number of pulses sent to the pulse motor.

The airflow outlet 58 is made to be proper in size by the combination of the shutter 53 and air duct 53 as described above. Thus, it is possible to make the cooling air to be blown across only the selected area of the pressure roller 34 through the airflow outlet 58.

3) Airflow Control

Figure 1:
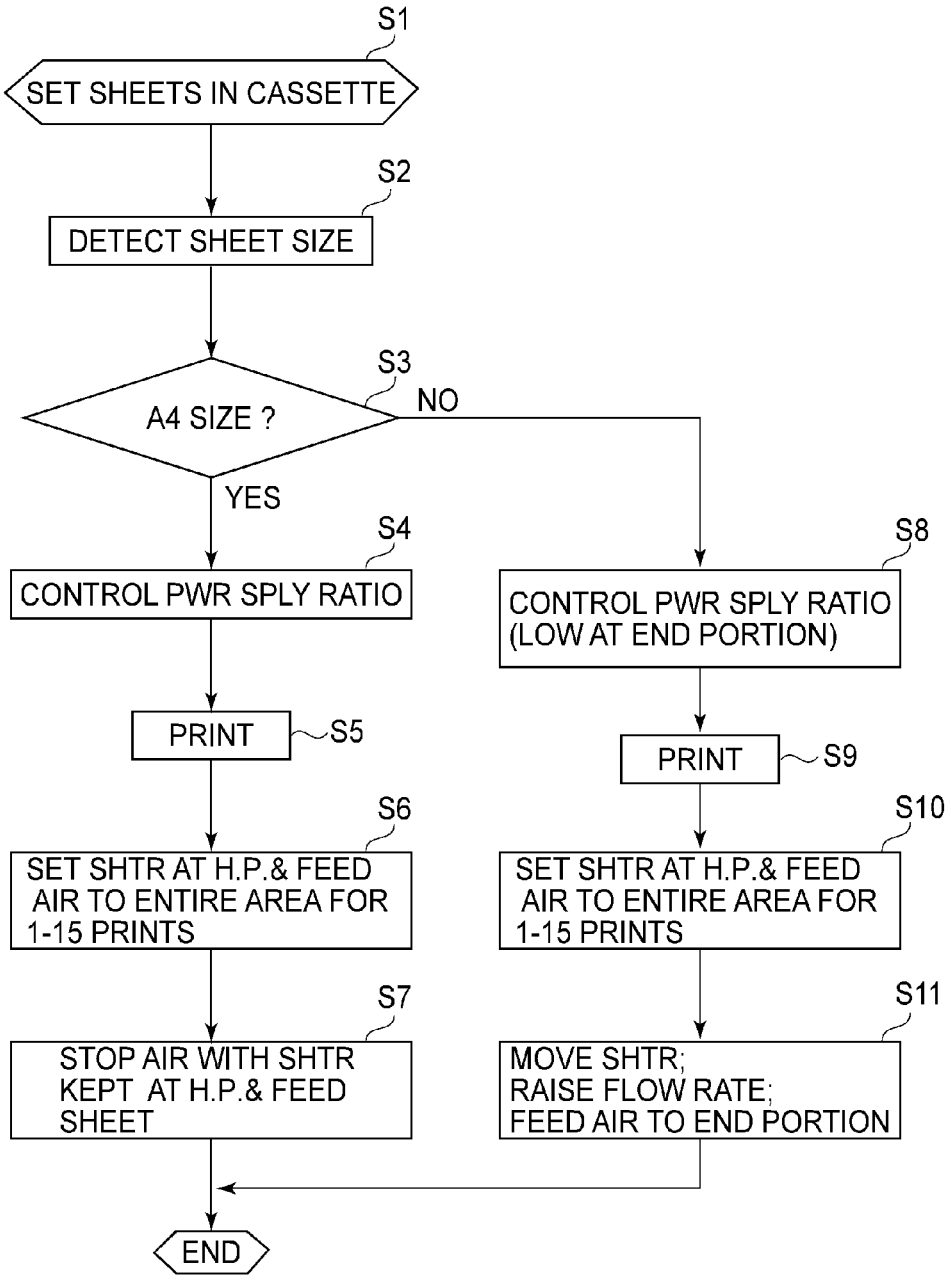
FIG. 1 is a flowchart of the operational sequence of the fixing device, as an image heating device, in the first embodiment of the present invention.
Figure 8:
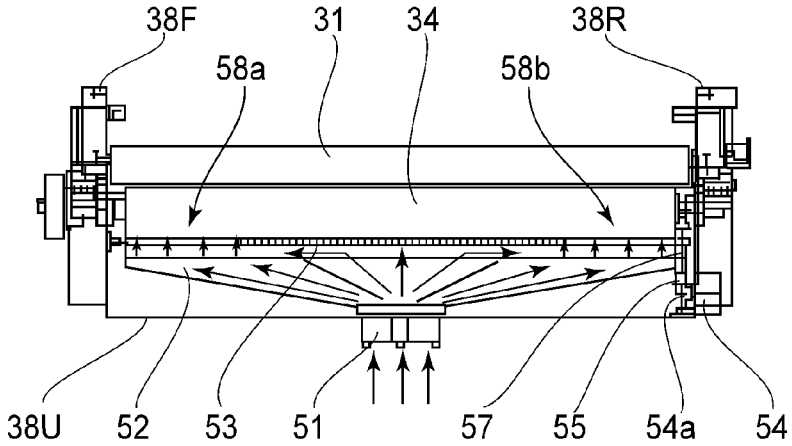
FIGS. 8(*a*) and 8(*b*) are sectional views of the essential portion of the fixing device in the first embodiment, at vertical and horizontal planes, respectively, perpendicular to the recording medium conveyance direction, when the fixing device is set for sending airflow across the portions of the pressure roller, which are outside the path of a sheet of recording medium of size A4.
Figure 8:
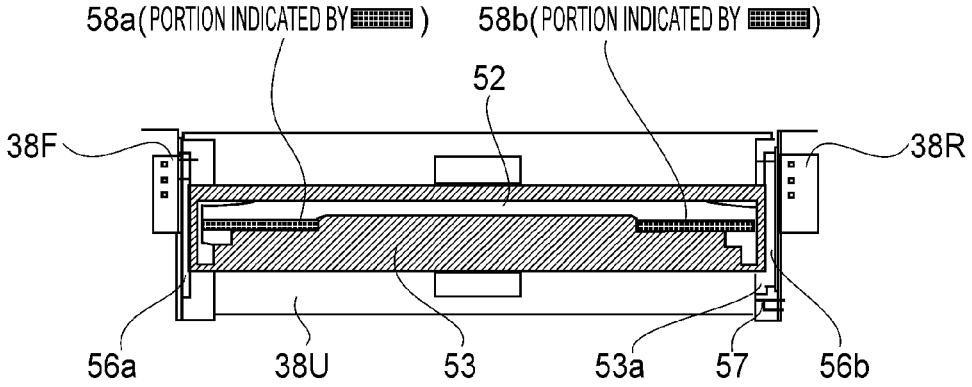
Figure 9:
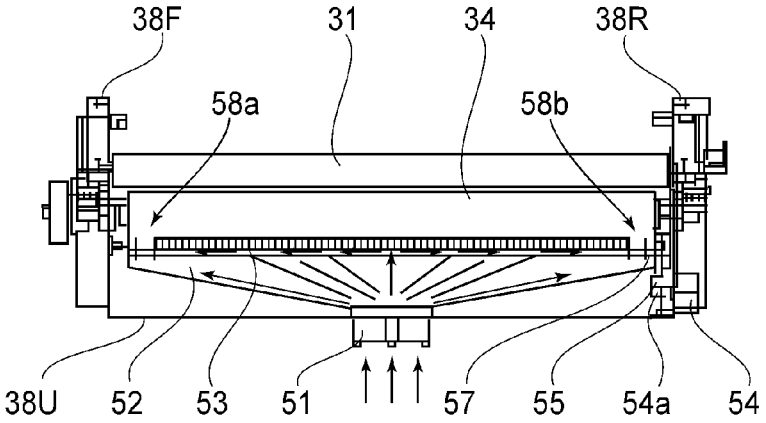
FIGS. 9(*a*) and 9(*b*) are sectional views of the essential portion of the fixing device in the first embodiment, at vertical and horizontal planes, respectively, perpendicular to the recording medium conveyance direction, when the fixing device is set for sending airflow across the portions of the pressure roller, which are outside the path of a sheet of recording medium of LTR size.
Figure 9:
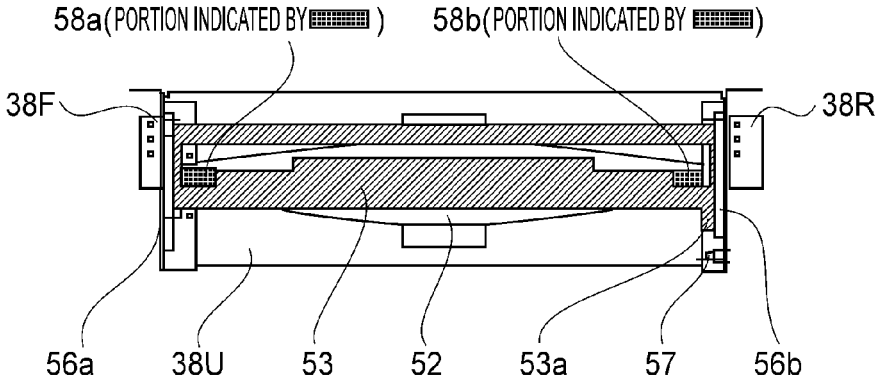

Next, referring to FIG. 1 (flowchart), and FIGS. 7-9 (drawing of blower unit 30*b*), the operation of the blower unit 30*b* in this embodiment is described, wherein the operation carried out when a sheet P of recording medium of size Pb (width) is conveyed through the fixing device 30, and the operation carried out when a sheet P of a large size Pa (width) is conveyed, are separately described. Regarding the condition described in S3 in FIG. 1, "sheet of paper of size A4 is conveyed in landscape position" means that a sheet of recording medium of size A4, that is, the largest sheet of recording medium conveyable through the fixation nip N, is conveyed in the landscape position so that the width of the sheet path Pa becomes equal to the measurement of the longer edge (297 mm) of the sheet, and "sheet of paper of size A5 is conveyed in the portrait position" means that a sheet of recording medium of size A5 is conveyed in such a position that the width Pb of the sheet path becomes equal to the measurement of the short edge of the sheet of paper of size A5.

When a sheet P of recording medium of size A4 is going to be conveyed through the fixing device 30, the shutter 53 is placed in its home position. Thus, a printing operation is carried out in such a condition that the air outlet 58 extends across roughly the entirety of the pressure roller 34 in terms of the lengthwise direction of the pressure roller 34 as shown in FIG. 7. When a sheet P of recording medium of size A5 is going to be conveyed through the fixing device 30, the shutter 53 is moved by a preset distance so that the air outlet 58 extends across only the out-of-sheet-path portions of the pressure roller 34 as shown in FIG. 8. Incidentally, shown in FIG. 9 is the positioning of the shutter 53 when a sheet P of recording medium of size LTR (279.4 mm) is conveyed.

Figure 11:
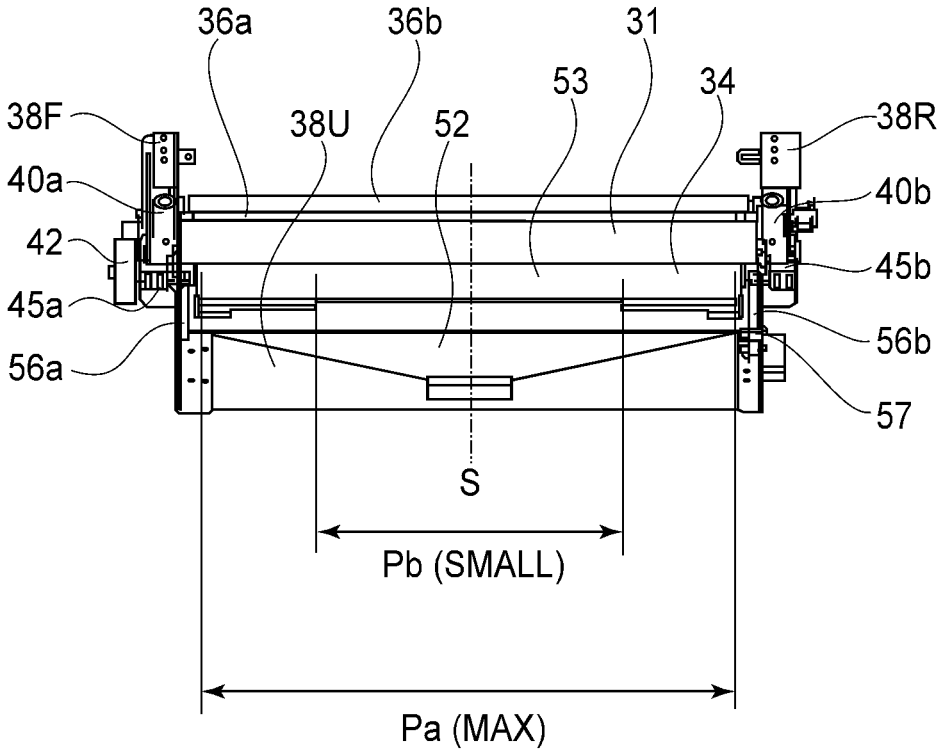
FIG. 11 is a top view of the essential portion of the fixing device in the first embodiment, and shows the positional relationship between the shutter opening and the size of the recording medium being conveyed through the fixing device.

FIG. 11 is a drawing which shows the relationship among the position of the sections of the opening of the shutter 53, sheet P of recording medium of size Pa (largest in width), and sheet P of recording medium of size Pb (narrowest in width), in terms of their lengthwise direction.

(When Widest Recording Medium is Conveyed)

As a user of the image forming apparatus 10 places sheets P of recording medium of size Pa (widest) in the recording medium cassette 11 (to convey sheets of size A4 in landscape position), an unshown sheet size sensor detects the width of the sheets, for example, 297 mm (length of sheet of size A4) (Steps S1, S2 and S3). Then, the unshown control circuit controls, in heat generation ratio, the heat generation members of the heat generating means, based on the signals from the unshown sheet size sensor, which indicates the detected size of the sheet. When the sheet of recording medium to be used for image formation is widest (width Pa), the heater 32 is controlled so that the heat generating members become uniform in the current ratio across their entire range in terms of their lengthwise direction (S4). Thus, a printing operation is carried out while heat is generated across the entire range of the heater 32 (S5).

FIG. 7 is a graph which shows the relationship between the temperature of the pressure roller 34 and the cumulative number of sheets of recording medium conveyed through the fixing device 30 since a printing operation was started when the temperature of the image forming apparatus 10 was at the level of the ambient temperature, and the relationship between the temperature of the fixation film 31 and the cumulative number of sheets of recording medium conveyed through the fixing device 30 conveyed through the fixing device 30 since the printing operation was started when the temperature of the image forming apparatus 10 is at the level of the ambient temperature. The image forming apparatus 10 in this embodiment is an example of an image forming apparatus capable of conveying 50 sheets of recording medium of size A4 per minute, in landscape position.

In the case of the image heating device in this embodiment, the temperature of the pressure roller 34 was no more than 75° C. up to the eight sheets after the starting of the image forming operation in which a substantial number of sheets of recording medium were continuously conveyed. Therefore, it was possible for the aforementioned "condensation slip" to occur while the first to eighth sheet of recording medium are conveyed. Therefore, the shutter 53 was positioned so that the air outlet 58 extended across the entire range of the pressure roller 34 in terms of the lengthwise direction of the pressure roller 34 as shown in FIG. 7, and the blower fan 51 was driven.

In other words, the blower unit 30*b* was operated in the first mode, in which cooling air is delivered across the entire range of the pressure roller 34 in terms of the lengthwise direction of the pressure roller 34. Thus, the slippage between the pressure roller 34 and film 31, which is attributable to the condensation of the water vapor from the sheets of recording medium, on the peripheral surface of the pressure roller 34, was prevented. It should be noted here that in a case where the pressure roller 34, that is, the target of the airflow generated by the blower fan 51 is, or estimated to be, low in temperature, the blower fan 51 is to be operated in the first mode.

In the case of the condition under which the fixing device 30 (image forming apparatus 10) in this embodiment was tested, it took only eight sheets of recording medium for the temperature of the pressure roller 34 to reach 70° C., above which the condensation slip does not occur. However, in consideration of the difference in properties among various types of recording media, and the difference among the various environments under which the image forming apparatus 10 is used, the air was blown toward the pressure roller 34 up to the fifteenth sheet, in order to afford some latitude (S6). That is, the fixing device 30 was operated in the first mode until the continuous conveyance of the first to fifteenth sheet ended. In step S6 in FIG. 1, the width of the sheet of recording medium was equivalent to the dimension of the entire area of the pressure roller 34, in terms of the lengthwise direction of the pressure roller 34, across which airflow was delivered by the blower fan 51. After the conveyance of the fifteenth sheet of recording medium, the blower fan 51 was stopped, and the sixteenth sheet and thereafter were continuously conveyed without operating the blower fan 51 (S7). That is, after the conveyance of the fifteenth sheet of recording medium, the printing operation in which a substantial number of sheets of recording medium are continuously conveyed was continued without placing the fixing device 30 in the first mode, for the following reason.

That is, once the temperature of the pressure roller 34 becomes 75° C. or higher, the condensation slip does not occur even if cooling air is not sent to the pressure roller 34. In the case of an image forming operation such as the one described above, in which the recording medium width is greater than a preset value, cooling air is not delivered to the out-of-sheet-path portions of the pressure roller 34 (fixing device 30 is not operated in second mode). In other words, after the fifteen sheets, the fixing device is operated neither in the first nor second mode. That is, after the fifteen sheets, the blower fan 51 is kept stationary.

(When Narrow Recording Medium is Conveyed)

As a user sets sheets of recording medium which are narrower than the widest (width Pa) sheet of recording medium conveyable through the fixing device 30 in the recording medium feeding cassette 11, the unshown sheet size sensor detects the width of the narrower sheet, for example, the dimension (148 mm) of the shorter edge of a sheet of recording medium of size A4 (Steps S1, S2 and S3). Then, the control circuit controls the heat generation ratio of the heating members of the heater 32. In the case of the conveyance of a narrow sheet P of recording medium, the control circuit controls the heating members so that the amount by which heat is generated by the lengthwise end portions of the heater 32 is less than that by the lengthwise center portion of the heater 32 (S8). It is under this condition that the control circuit starts the printing operation (S9).

Figure 13:
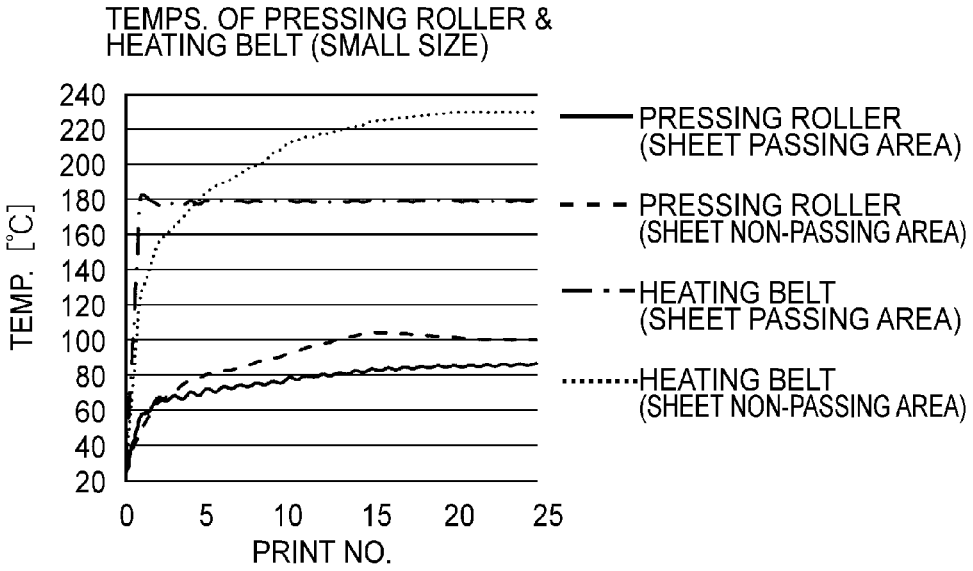
FIG. 13 is a graph which shows the relationship between the temperature of the pressure roller and cumulative number of continuously conveyed sheets of recording medium which was narrower than a sheet of recording medium of size A4, and the relationship between the temperature of the fixation film and cumulative number of continuously conveyed sheets of recording medium of size A4.
Figure 14:
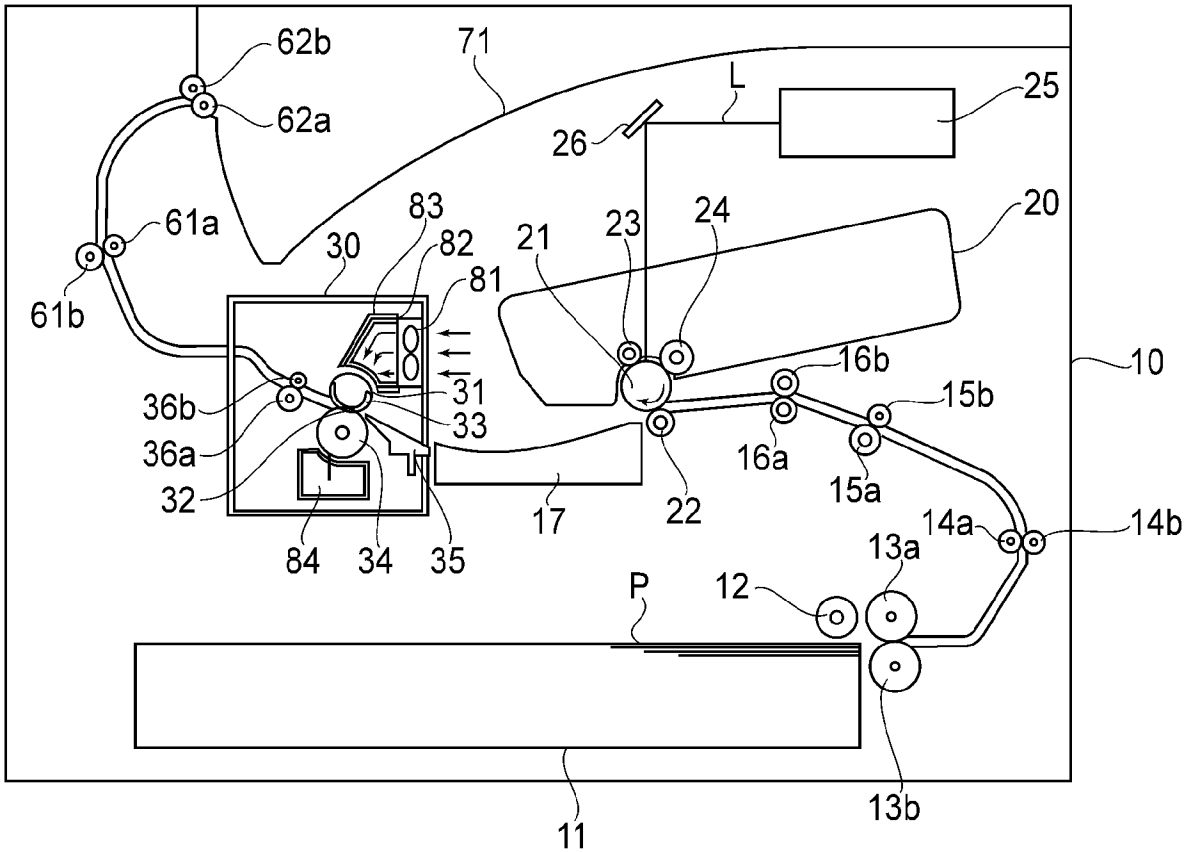
FIG. 14 is a schematic sectional view of one of the typical conventional image forming apparatuses, at a vertical plane perpendicular to the recording medium conveyance direction of the apparatus.
Figure 15:
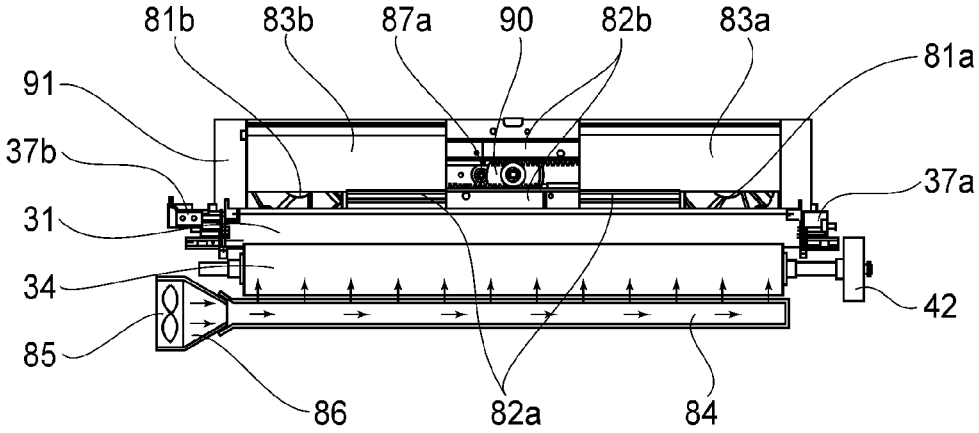
FIG. 15 is a schematic sectional view of one of the typical conventional fixing devices, at a vertical plane perpendicular to the recording medium conveyance direction of the device.
Figure 16:
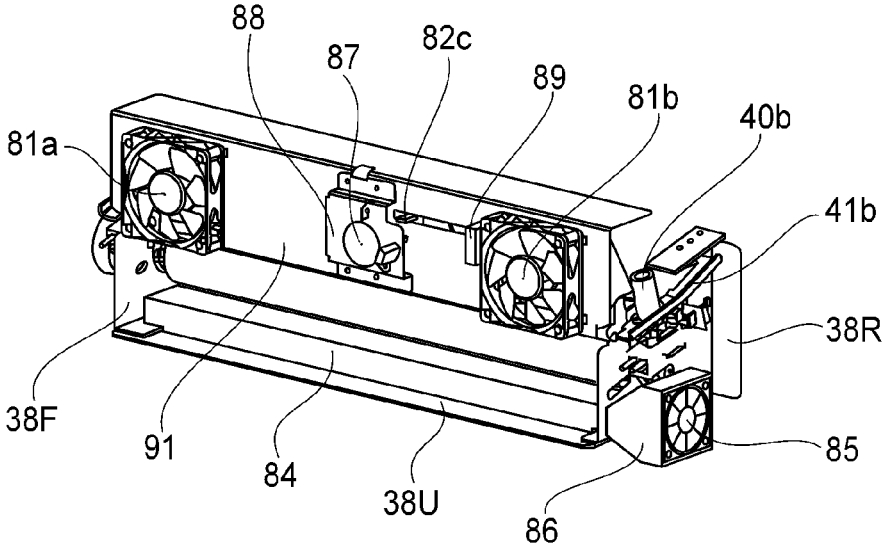
FIG. 16 is a perspective view of the cooling unit of the conventional fixing device.

FIG. 13, which is a graph showing the changes in the relationship between the temperature of the pressure roller 34 (portion within sheet path) and the cumulative number of sheets continuously conveyed through the fixing device 30, changes in the relationship between the temperature of the pressure roller 34 (portion outside sheet path) and the cumulative number of sheets continuously conveyed through the fixing device 30, changes in the relationship between the temperature of the heating film 31 (portion within sheet path) and the cumulative number of sheets of continuously conveyed through the fixing device 30, and the temperature of the fixing device 30 (portions outside sheet path) and the cumulative number of sheets continuously conveyed through the fixing device 30, after a substantial number of narrow sheets of recording medium began to be conveyed when the temperature of the fixing device 30 is at the level of the ambient temperature.

In the case of an image forming operation in which a substantial number of narrow sheets P of recording medium are continuously conveyed, while the first to eighth sheets of recording medium were conveyed, the temperature of the pressure roller 34 was no more than 75° C., and therefore, it was possible for the condensation slip to occur. Therefore, the shutter 53 was positioned so that the opening of the shutter extends across roughly the entire range of the pressure roller 34 in terms of the lengthwise direction of the pressure roller 34, to allow the cooling air to be impinged roughly on the entire range of the pressure roller 34, and then, the blower fan 51 was driven to prevent the condensation slip as shown in FIG. 7. That is, the cooling air was delivered across the entire lengthwise range of the pressure roller 34 (first mode). Thus, the water vapor from the sheets P of recording medium was dispersed by the cooling air, and therefore, the pressure roller 34 and film 31 did not slip relative to each other.

In this embodiment, in a case where the pressure roller 34, that is, the target of the airflow generated by the blower fan 51 is, or estimated to be, low in temperature, the fixing device 30 is to be operated in the first mode.

Figure 12:
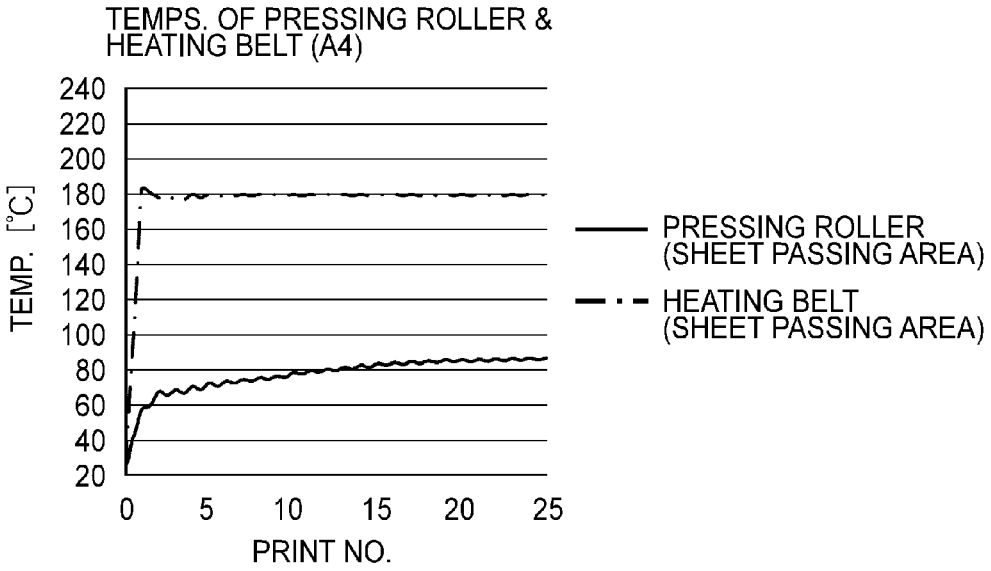
FIG. 12 is a graph which shows the relationship between the temperature of the pressure roller and cumulative number of continuously conveyed sheets of recording medium of size A4, and the relationship between the temperature of the fixation film and cumulative number of continuously conveyed sheets of recording medium of size A4, when the sheets were conveyed in landscape position.

As approximately 15 narrow sheets of recording medium were conveyed through the fixing device 30 since the beginning of the printing operation, the temperature of the pressure roller 34 became no less than 75° C., above which the condensation slip does not occur, the temperature of the film 31 approached 240° C., that is, the highest temperature level the film 31 can withstand, as shown in FIG. 12. At this point in time, that is, immediately after the conveyance of the fifteenth sheet of recording medium, the shutter 53 was moved to the position in which it allows the cooling air to flow through the second sections of the opening, which corresponds in position to the portions of the pressure roller 34, which are outside the path of the narrow sheet P of recording medium, in order to prevent the temperature of the film 31 from excessively increasing.

The cooling air was delivered across the portions of the pressure roller 34, which were outside the path of the narrow sheet of recording medium (second mode) as stated in the block S8 in FIG. 1. In S11 (second mode), the amount by which the blower fan 51 blows air is made greater than in the first mode.

As the cooling air was sent to the out-of-sheet-path portions of the pressure roller 34, these portions of the pressure roller 34 reduced in temperature. Therefore, the portions of the film 31, which were rotating in contact with the out-of-sheet-path portions of the pressure roller 34, were robbed of heat by the out-of-sheet-path portions of the pressure roller 34. Therefore, the temperature of the out-of-sheet-path portions of the film 31 was kept at roughly 230° C., which is lower than the highest temperature level which the film 31 can withstand.

This embodiment was described with reference to the image forming operation in which the widest sheets of recording medium (297 mm in width) conveyable, in the landscape position, through the fixing device 30 (image forming apparatus 10) were used, and the image forming operation in which the narrower sheets of recording medium (148 mm in width) were used. In an operation in which sheets of recording medium, the width of which is between 297 mm and 148 mm are conveyed, the fixing device 30 is to be operated as follows. That is, the fixing device 30 is to be operated following steps S8-S11 in FIG. 1, and the shutter 53 is to be positioned according to the size of the sheets of recording medium (FIG. 9 shows shutter position while sheets P of LTR size are conveyed).

Further, this embodiment was described with reference to the image forming operation in which the fixing device 30 was switched in operational mode between the first mode, that is, the mode in which cooling air is delivered across the entirety of the pressure roller 34 in terms of the lengthwise direction of the pressure roller 34, and the second mode, that is, the mode in which the cooling air is delivered to the portions of the pressure roller 34, which are outside the recording medium path, according to the number of continuously outputted prints. However, this embodiment is not intended to limit the present invention in scope. For example, the present invention is applicable to also a fixing device which has a temperature detecting member on at least one of its pressure roller 34 and film 31, and is switchable in operational mode between the first and second modes according to the temperature level detected by the temperature detecting member.

Further, the present invention is applicable to an image forming apparatus which has an ambient temperature sensor, and changes the timing with which its fixing device is switched in operational mode between the first and second modes, based on the temperature level detected by the ambient temperature sensor. For example, when the image forming apparatus is operated in an environment which is low in temperature, the mode switch timing is delayed by five sheets from 15th sheet to 20th sheet, whereas when the image forming apparatus is operated in an environment which is high in temperature, the mode switch timing is advanced by five sheets from 15th sheet to 10th sheet.

As described above, according to this embodiment of the present invention, it is possible to use a single fan for preventing both the problem that the out-of-sheet-path portion of the pressure roller 34 excessively increase in temperature, and the problem that the condensation of the water vapor from sheets of recording medium upon the pressure roller 34 causes the pressure roller 34 and fixation film 31 slip relative to each other. Therefore, it is possible to reduce an image forming apparatus in size and cost. Incidentally, the above-described technological matters may be variously combined within the scope of the present invention. That is, the various modifications of this embodiment, which are going to be described next, fall within the scope of the present invention.

(Modification 1)

Regarding the structure of a fixing device, the application of the present invention is not limited to a fixing device, such as the one in the preceding embodiment, which employs a heating film. That is, the present invention is also applicable to a fixing device structured differently from the one in the preceding embodiment. For example, the present invention is applicable to a fixing device which employs an electromagnetic heating means.

(Modification 2)

In the above-described embodiment, a single fan is placed in the adjacencies of the pressure roller and is used to deliver cooling air to the pressure roller in order to deal with both the condensation slip and the excessive temperature increase of the out-of-sheet-path portions of the pressure roller. However, the preceding embodiment is not intended to limit the present invention in terms of the structure of a fixing device. For example, the present invention is also applicable to a fixing device structured so that a single fan is placed in the adjacencies of the pressure roller, and the airflow generated by the fan is delivered to both the pressure roller 34 and film 31 with the use of an air duct having two outlets.

(Modification 3)

In the above described embodiment, the pressure applying member was a rotatable roller. However, the present invention is also applicable to a fixing device having a pressure applying stationary pad in stead of the rotatable roller.

(Modification 4)

The present invention is applicable to a fixing apparatus structured so that when a sheet of recording medium is conveyed through the fixing device, it is guided by only one of its lateral edges.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 207012/2011 filed Sep. 22, 2011 which is hereby incorporated by reference.

What is claimed is:

1. An image forming apparatus for forming a toner image on a recording material, said apparatus comprising:

an image forming portion configured to form an unfixed toner image on the recording material;

a fixing portion configured to fix the unfixed toner image on the recording material at a nip portion while conveying the recording material bearing the unfixed toner image, the fixing portion including a fixing member, contacting the unfixed toner image and a pressing member forming the nip portion therebetween;

an air blowing member facing the pressing member and configured to blow the air toward said pressing member; and a shutter, provided between said air blowing member and said pressing member, configured to control an air blowing region of said pressing member, wherein said image forming apparatus is configured to execute a first mode for blowing air to the air blowing region set to an entire sheet-passing area of said pressing member by the air blowing member, and a second mode for blowing air to the air blowing region set to only a non-sheet-passing area of the pressing member by the air blowing member.

2. An image forming apparatus according to claim 1, wherein before the number of prints from the start of a continuous print operation on a recording material of a predetermined size exceeds a predetermined number, the first mode is executed, and after the number of prints from start of the continuous print operation on the recording material exceeds the predetermined number, the second mode is executed.

3. An image forming apparatus according to claim 1, wherein when the temperature of said pressing member is lower than a predetermined temperature, the first mode is executed, and when the temperature of said pressing member is higher than the predetermined temperature, the second mode is executed.

4. An image forming apparatus according to claim 1, wherein said shutter is movable in a perpendicular direction to a longitudinal direction of the pressing member, and is provided with a first opening corresponding to the entire sheet-passing area of the pressing member, and a second opening corresponding to the non-sheet-passing area of the pressing member, and the first opening and the second opening are juxtaposed in the perpendicular direction, and wherein a position of said shutter in the first mode is such that air is blown to said pressing member through the first opening, and a position of said shutter in the second mode is such that the air is blown to said pressing member through the second opening.

5. An image forming apparatus according to claim 4, wherein the second opening includes a plurality of apertures corresponding to non-sheet-passing areas of a plurality of said recording materials having different widths.

6. An image forming apparatus according to claim 1, wherein said fixing member includes a cylindrical film.

7. An image forming apparatus according to claim 6, wherein said fixing portion includes a heater contacting an inner surface of the film and forming the nip portion with said pressing member via said film.

8. An image forming apparatus according to claim 1, wherein the non-sheet-passing area of the pressing member includes an area of the pressing member on which a largest size recording material conveyable at the nip portion passes and a small size recording material, smaller than the largest size recording material, does not pass.

9. An image forming apparatus according to claim 1, the air blowing member is provided on an opposite side to the fixing member across a recording material conveyed at the nip portion.

10. An image forming apparatus for forming a toner image on a recording material, the apparatus comprising:

an image forming portion configured to form an unfixed toner image on the recording material;

a fixing portion configured to fix the unfixed toner image on the recording material at a nip portion while conveying the recording material bearing the unfixed toner image, the fixing portion includes a fixing member, contacting the unfixed toner image, and a pressing member forming the nip portion therebetween;

an air blowing member, facing the pressing member, configured to blow air toward the pressing member; and a shutter, provided between the air blowing member and the pressing member, configured to control an air blowing region of the pressing member, wherein the image forming apparatus is configured to execute a first mode in which the air blowing member blows air to the air blowing region of the pressing member set to a first area, and a second mode in which the air blowing member blows air to the air blowing region of the pressing member set to a second area that is a greater distance from a recording material feeding reference position in the longitudinal direction of the pressing member than the first area.

11. An image forming apparatus according to claim 10, wherein the shutter is movable in a perpendicular direction to the longitudinal direction, and is provided with a first opening corresponding to the first area of the pressing member, and a second opening corresponding to the second area of the pressing member, and the first opening and the second opening are juxtaposed in the perpendicular direction, and wherein a position of the shutter in the first mode is such that air is blown to the pressing member through the first opening, and a position of the shutter in the second mode is such that the air is blown to the pressing member through the second opening.

12. An image forming apparatus according to claim 10, wherein the air blowing member is provided on an opposite side to the fixing member across a recording material conveyed at the nip portion.

* * * * *